United States Patent [19]

Johnson et al.

[11] Patent Number: 4,508,305

[45] Date of Patent: Apr. 2, 1985

[54] TILT LOCK MEANS FOR A DRAFTING TABLE

[75] Inventors: Sigurd A. Johnson, Mission Viejo; Frank S. Avella, Irvine; Robert I. Jones, Norco, all of Calif.

[73] Assignee: Plan Hold Corporation, Irvine, Calif.

[21] Appl. No.: 492,229

[22] Filed: May 6, 1983

[51] Int. Cl.[3] ..... A47F 5/12

[52] U.S. Cl. ..... 208/455; 248/455; 248/479; 292/306

[58] Field of Search ..... 248/455, 457, 454, 447, 248/479, 410, 371, 185, 663, 72; 108/9, 10; 292/338, 306

[56] References Cited

U.S. PATENT DOCUMENTS

| | | | |
|---|---|---|---|
| 2,159,474 | 5/1939 | Drucks | 292/306 |
| 2,702,205 | 2/1955 | Germain | 292/306 |
| 2,833,081 | 5/1958 | Pottern | 108/9 |
| 3,298,646 | 1/1967 | van Buren | 248/72 |
| 3,441,303 | 4/1969 | Tabor | 292/306 |
| 4,215,885 | 8/1980 | McCray | 292/338 |
| 4,314,407 | 2/1982 | Kawahara | 108/9 |

FOREIGN PATENT DOCUMENTS

| | | | |
|---|---|---|---|
| 2014645 | 8/1979 | United Kingdom | 292/338 |

*Primary Examiner*—William H. Schultz
*Assistant Examiner*—Ramon O. Ramirez
*Attorney, Agent, or Firm*—Poms, Smith, Lande & Rose

[57] ABSTRACT

A locking device for infinitely varying the inclination of a drawing board mounted about a hinge axis along one edge of a base or table structure between a maximum tilt angle and a minimum angle such as horizontal in which a rod is pivotally connected at one end to a drawing board and extends downwardly alongside the base structure, a lock member is pivotally mounted on the base structure and has a plate portion having a hole therein to receive said rod, said hole having a configuration providing frictional contact with said rod surface in relative angular positions of the rod as determined by the inclination of the drawing board and by the pivotal movement of the lock member, the configuration of the hole maximizing such frictional contact, and a magnet on the base structure cooperable with said lock member to hold the lock member in release position with respect to the rod, the lock member being automatically disengaged from said magnet in one position of the drawing board.

16 Claims, 6 Drawing Figures

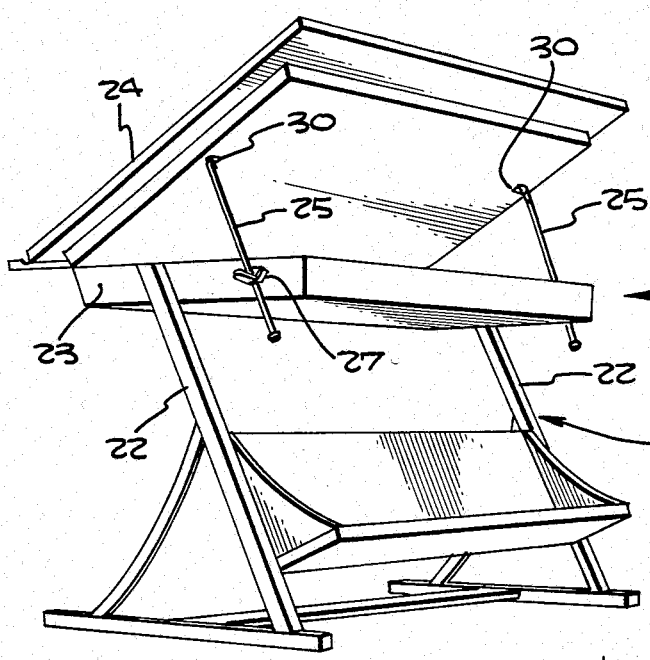
Fig. 1.
Fig. 6.
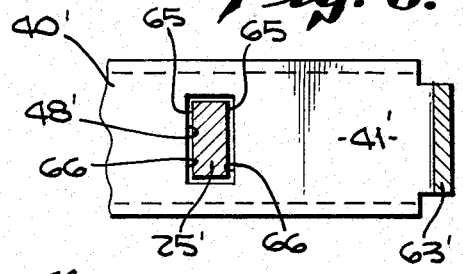
Fig. 2.
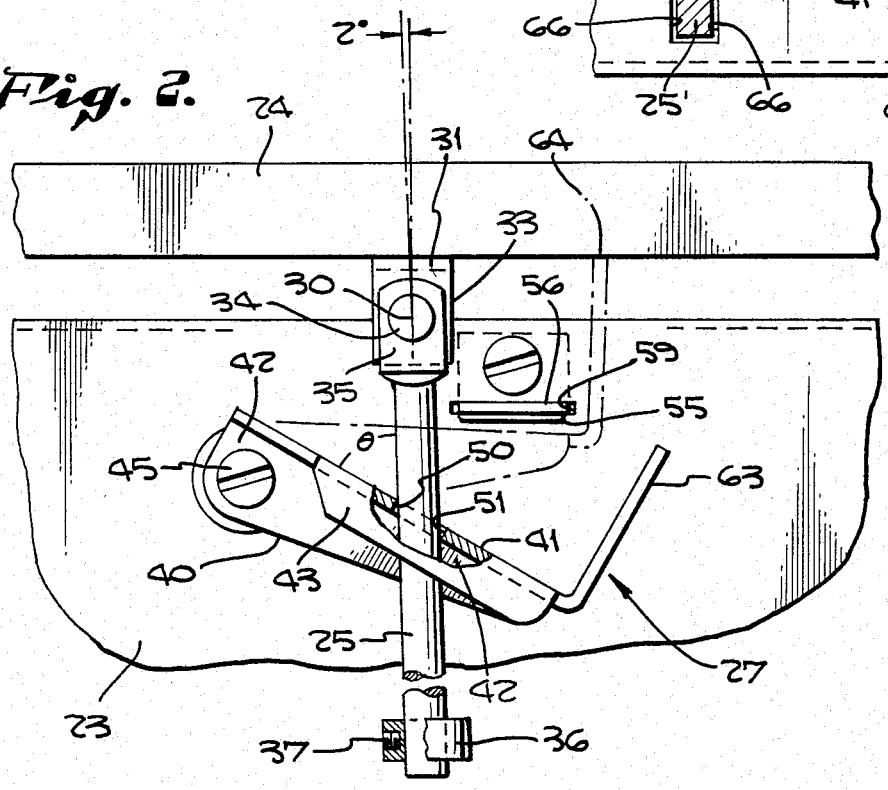

59°
θ

TILT LOCK MEANS FOR A DRAFTING TABLE

BACKGROUND OF THE INVENTION

This invention relates to a locking device for use on drafting board tables in which a drafting board is adjustably inclined to a desired selected angle by the draftsman to facilitate his work thereon. Each draftsman usually has a preferred drafting board angle depending upon the draftsman's physical characteristics, the height of the drafting table and the location of the drawing on the board.

Prior proposed constructions for adjusting the tilt angle of a drawing board on a drafting table have included the provision of rack bars having rack teeth on the table and engaged by pivoted legs, interconnected transversely, carried by the drafting board. Multiple adjustment of the inclination of the table in increments was related to the spacing of the track teeth on the bar. When the pivoted legs were interconnected, then the entire leg structure was required to be manipulated to properly engage the legs with the rack teeth. In the event the legs were not interconnected, then the draftsman was required to adjust each leg at each side of the table.

Another proposed prior construction was to pivotally connect a rod to each side of the drafting table and provide a knob with a friction screw on the drafting table for slidable adjustment of each rod to a desired board position. To accomplish such adjustment, the draftsman was required to go each side of the table to adjust the friction screw by the knob. Intermediate adjustments were awkward to make because of the weight of the table and the necessity for precise individual adjustment at each side of the table.

Pneumatically operated door closures are often provided with a slidable washer on the piston rod of the door closure, the washer having an axial extending portion adapted to abut one end of a cylinder to position the wahser at an angle to frictionally prevent further sliding of the piston rod within the cylinder at a selected open position of the door. Such lock washer was provided with a circular hole through which the circular cross sectional piston rod passed. Frictional engagement of the edge margins of the hole with the rod occurred essentially at a tangent of the cylindrical surface of the rod with the circular edge margins of the hole in the washer. Loads in such a door closure are not substantial, and the lock washer was not secured to another member and such minimal frictional contact was acceptable.

SUMMARY OF THE INVENTION

The present invention relates to a locking device for use on each side of a drafting table for adjusting inclination of the drafting board in an infinite number of positions between a maximum almost vertical tilt position to a minimum tilt or horizontal position. The invention contemplates such a locking device which minimizes manipulation of the drawing board by the draftsman to achieve a desired selected position and in which the draftsman may, if desired, achieve such selected position by the use of one hand by lifting the drawing board at the edge opposite the hinged connection of the board to the drafting table.

The primary object of the invention is to provide a locking device utilizing a rod or elongated member of selected cross sectional configuration and a lock plate pivoted to a base table structure having a hole therein to receive said rod, the hole being especially configured to provide maximum frictional contact.

An object of the invention is to provide such a lock tilting device which is essentially automatically operable from a horizontal position of the board upwardly to a maximum inclined position.

Another object of the invention is to provide a locking device as described above wherein automatic release means are provided to permit movement of the drafting table from an upwardly inclined working position to horizontal position.

A further object of the invention is to provide a magnet means for retaining the lock member in a release position while downward movement of the table is made.

A still further object of the invention is to provide a locking device as described above wherein the release means for the lock member is automatically disengageable when the drawing board reaches a horizontal position to facilitate selected upward movement of the board to a desired tilt position of the board.

A still further object of the present invention is to provide various modifications of the cooperable frictional engagement between the rod connected to the drafting board and the hole in a lock member whereby maximum frictional contact for the configurations employed is achieved.

A general object of the invention is to provide a novel locking device associated with a longitudinally movable load supporting rod in which lock position of the rod is facilitated.

Other objects and advantages of the present invention will be readily apparent from the following description of the drawings in which exemplary embodiments of the invention are shown.

IN THE DRAWINGS

FIG. 1 is a perspective view of a drafting board table embodying the present invention with the drafting board at an inclined angle.

FIG. 2 is an enlarged fragmentary elevational view, partly in section of a tilt lock device embodying this invention, the lock device shown in full lines illustrating a locking position, the lock device shown in phantom lines indicating disengaged position of the release means when the drafting board is virtually horizontal.

FIG. 6 is a fragmentary sectional view taken in the same plane as that of FIG. 5 and showing a modification of the cross sectional configuration of the lock rod and of the hole in the lock member.

DETAILED DESCRIPTION OF THE INVENTION

Figures 3, 4, 5:
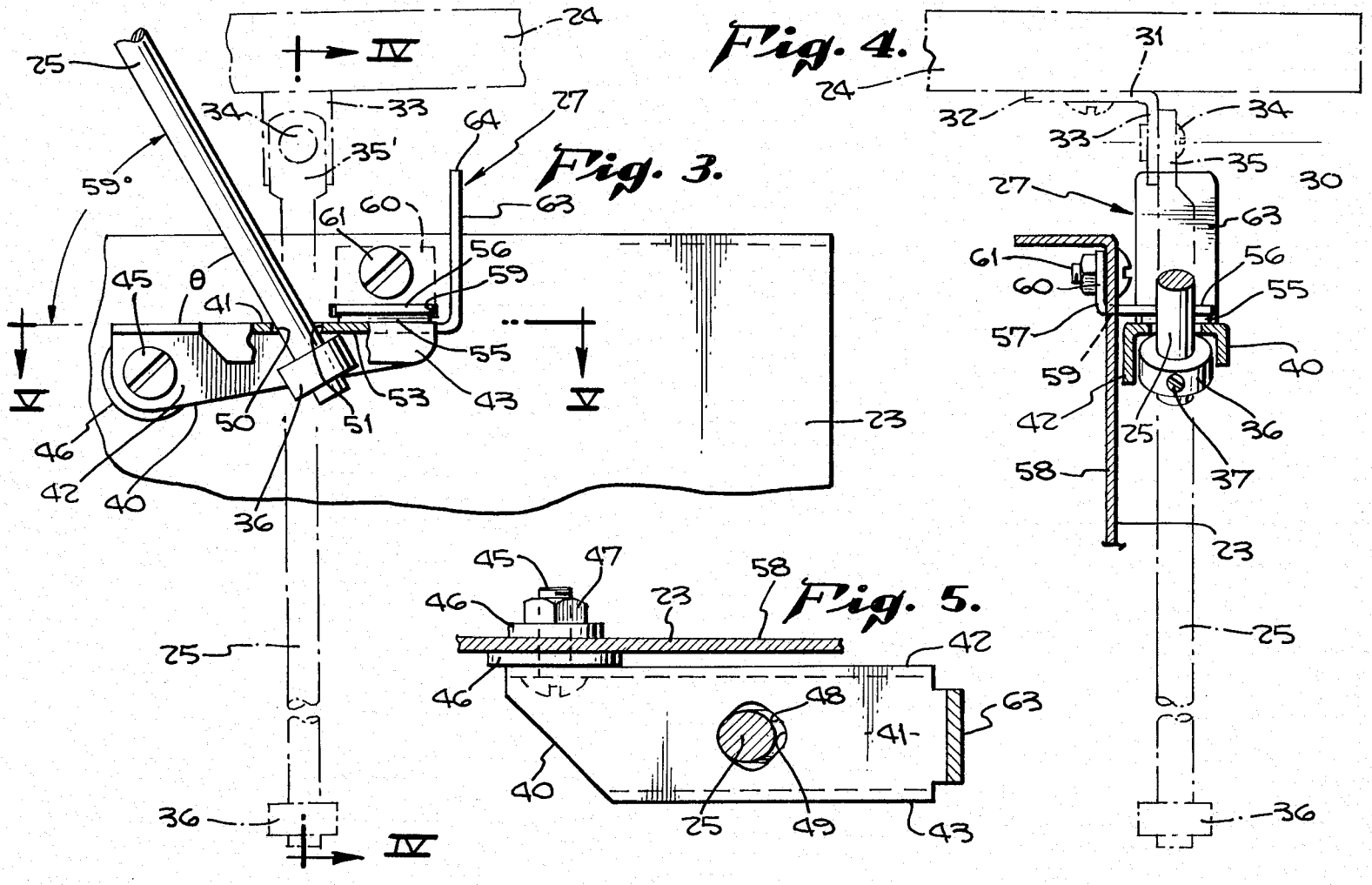
FIG. 3 is an enlarged fragmentary elevational view, partly in section, of the locking device shown in FIG. 2, the lock device being shown retained in release position in full lines, the lock rod and drawing board in phantom lines illustrating their position just prior to engagement with the lock device for automatic release thereof.
FIG. 4 is a sectional view taken in the plane indicated by line IV—IV of FIG. 3 and showing the lock rod and drafting board in phantom lines in the position thereof as hown in phantom lines in FIG. 3.
FIG. 5 is an enlarged fragmentary sectional view taken in the plane indicated by line V—V of FIG. 3.

In FIG. 1 a drafting table generally indicated at 20 includes a base table or support means 21 having suitable supporting legs 22 carrying a table tray 23 having a top opening into which various drafting accessories may placed. Hingedly connected to the tray 23 is a drafting board 24 of suitable construction and adapted to be raised from a horizontal position parallel to the top edges of tray 23 to inclined positions including a maximum inclined position by means of supporting elongated members or lock rods 25 adjacent each side of board 24. Each rod 25 is releasably retained by a locking device 27 embodying this invention. It will be understood that other types of base support means 22 may be employed to support a drafting board such as a four legged table or other base frame structures. A drafting board 24 of standard size; that is, about 37½" high and 60–72" in width may weigh in the order of 100 lbs. when fully equipped with board mounted drafting lamps and other drafting accessories such as mechanical T-squares and angles. A drafting board with all of its accessories becomes relatively heavy.

Locking device 27 may comprises the elongated support member or lock rod 25 having a pivotal connection at 30 at one end to board 24. Pivotal connection 30 may include an angle bracket 31 having one leg 32 secured to the undersurface of board 24 and a depending leg 33 having an opening to receive a pivot pin 34. The upper end of rod 25 may be provided with an offset flattened end 35 having a hole alignable with the hole in leg 33 for reception of the pivot pin 34.

Support rod 25, in this embodiment is cylindrical having a circular cross section and has a length sufficient to raise drafting board 24 to a maximum inclined position which may be an almost vertical position while the lower free end of rod 25 is in cooperable engagement with locking device 27. The lower end of rod 25 may be provided with an adjustable collar or stop 36 provided with a set screw 37 for positioning the collar 37 longitudinally on the rod 25. It will be understood that the adjustable collar 36 may be located at other positions on rod 25 to limit the selected maximum inclination of board 24.

Locking device 27 also includes a lock member 40 having a plate portion 41 disposed in a plane transverse to the longitudinal axis of rod 25. Lock member 40 includes a depending inboard side flange or wall 42 of generally tapered shape and an outboard depending wall 43 extending for a major portion of the length of plate portion 41. Depending walls 43 and 43 serve to reinforce the plate portion 41 against bending about a transverse axis and stiffens the plate portion 41 so that drafting board loads may be accommodated by the plate portion 41. At one end, depending wall 42 is provided with a port for a pivotal connection at 45 to a side wall of the tray 23 of the base support means. Pivotal connection 45 (FIG. 5) may include a pair of inboard and outboard relatively large diameter bearing washers 46 and a suitable screw bolt assembly 47 for pivotally securing lock member 40. The pivotal connection 45 is relatively antifriction to permit the lock member 40 to be readily moved by gravitational forces as well as to respond to relative movement of lock rod 25.

Plate portion 41 is provided with a hole 48 in spaced relation to the axis of pivotal connection 45 for reception therethrough of rod 25. Hole 48 is noncircular and includes edges 49 disposed on the longitudinal axis of plate portion 41 having radii substantially equivalent to the radii at the ends of the major axis of an elliptic section formed by the plane of plate portion 41 passing through the circular rod 25 when plate portion 41 forms an angle theta ($\theta$) with the axis of the rod. The included angle theta remains substantially uniform through out inclinde positions of the board to provide locking in maximum vertical position as partially indicated in FIG. 3 and in minimum substantially horizontal position as shown in FIG. 2. The maintenance of a substantially constant included angle theta between the plate portion 41 and the rod 25 is provided by the pivotal movement of lock member 40 about its axis and by the path taken by the pivotal connection 30 of rod 25 as the board is moved about its hinge axis. As illustrated, the angle theta is approximately 59° and provides biting frictional contact between the surfaces of rod 25 and the edges of hole 48 as illustrated at 50 and 51 of FIG. 2, contact 50 being on the upper edge of the hole and contact 51 being on the diametrically opposite lower edge of the hole. Variations in the thickness of plate portion 41 and in the size of hole 48 relative to the cross sectional area of rod 25 may cause some variance in the included angle theta. Included angle theta may be varied between about 30° to 70°. It should be noted from FIG. 2 that the location of the pivotal connection 45 for the lock member 40 is so related to the pivotal connection 30 of the upper end of rod 25 on the drawing board that when the board, as shown in FIG., 2 is in horizontal position, the axis of the rod 25 lies at least 2° from the vertical and the angle of the plate portion 41 with respect to horizontal is approximately 29°. Thus, even when the board is very slightly inclined from the horizontal, the lock device 27 will be operable to position the board in such desired position.

Because the drafting board and it accessories impart an axially directed load on rod 25 when the board is in horizontal position; for example, as shown in FIG. 2, it will be apparent that the lock device 27 will not prevent the drawing board from being raised from horizontal position. Relieving the load imposed upon the locking device overcomes the frictional contact and engagement at 50 and 51 of the rod with the plate portion 41 and the rod may be moved longitudinally through hole 48. The board may be raised as by a single hand at the center thereof and when the desired inclination of the board is reached, release of the hand and transferring the drawing board load again to the rod 25 will automatically cause the lock member 40 to lock the rods and the board in the selected position.

With the drawing board in an intermediate inclined position and held by the lock members 40 at opposite sides of the drawing board table, movemeht of the board to another inclined position may be accomplished in two ways. One method is to raise the drawing board by one hand to its maximum tilted position at which the stop collar 36 on the end of rod 25 moves into abutment with the undersurface of plate portion 41 as at 53 and carries the lock member 40 upwardly for holding engagement with a magnet member 55 carried on the bottom face of a bracket leg 56 of bracket 57 secured to side wall 58 of the base frame structure. As shown in FIG. 4, bracket 57 may extend through a horizontal slot 59 in the wall and has an upstanding leg 60 secured as by a screw nut assembly 61. Lock member 40 is made of magnetic material and magnet 55 is selected with a suitable magnetic force to readily hold the lock member 40 in contact therewith. The slot 59 is made somewhat oversize with loose tolerances so that magnet member 55 may readily adjust its position to fully engage the surface of the magnet 55 with the opposed top surface of plate portion 41.

When lock member 40 is in magnetic retained contact as shown in FIG. 3, the frictional engagement of rod 25 at 50 and 51 is substantially broken and reduced so that the rod may readily pass downwardly through opening 48 until the board reaches its horizontal position.

At such horizontal position, the magnetic engagement of plate portion 41 with magnet 55 is severed and released by means of an upstanding end portion 63 provided at the end of plate portion 41 opposite pivotal connection 45, the height of end portion 63 being such that abutting contact is made at 64 with the bottom surface of drawing board 24 to displace the lock member 40 downwardly about its pivotal connection 45 to release and break the magnetic engagement of the magnet 55. When the lock member is thus released from its uppermost position, it will move downwardly by gravity until it assumes its locking position as indicated at FIG. 2 at an angle of approximately 29° to horizontal. The drawing board may then be lifted as previously described to a new selected inclined position and the lock members 40 will automatically retain the drawing board in such selected position.

Another method of moving the drawing board to a different inclined position from that first selected may be accomplished by manually moving each of the lock member 40 into upper position to engage the magnet retention means 55. In such manual movement of the lock member, it will be apparent that the draftsman must move from one side of the table to the other while holding the drafting board in its approximately first inclined position. After both locking devices are engaged and held in lock rod release position, the drafting board may be moved upwardly or downwardly to a second desired inclined position. The lock member may be automatically released by lowering the board to full horizontal position to cause abutment of end portion 63 with the bottom surface of the board as at 64 or each lock member 40 may be manually released from the retention magnet 55.

The configuration of exemplary hole 48 relative to the cross sectional shape of the rod 25 is such that approximately 50% or more of the rod surface at the edges of hole 48 is frictionally engaged by the edges. Because of the loads imposed on the lock member 40 after repeated use, the hole edge margins of plate portion 41 may become deformed in the absence of measures taken to prevent such deformation. Rigidity of lock member 40 against bending is resisted by the walls 42 and 43. Plate portion 41 may also be treated as by case hardening in order to prevent deformation of the configuration of hole 48. Rod 25 may be made of a cold drawn steel rod with zinc plating. In the event greater loads are encountered, lock member 40 may be made from a high strength low alloy steel and tempered to further resist deformation.

In FIG. 6 a modification of the lock member 40 and rod 25 is illustrated, (like parts being given same reference numerals with a prime sign) the lock member 40′ being provided with a rectangular opening 48′ lying transversely of the length of plate portions 41′. Rod 25′ may be made of corresponding rectangular cross section of slightly smaller cross sectional area than hole 48′ to provide frictional contact between the long parallel sides 65 of rod 25′ with the edge margins 66 of the opening 48′. It will thus be apparent that the frictional contact of such a rod 25′ with lock member 40 exceeds 50% of the peripheral surface of rod 25′ at the plane of the plate portion at hole 48′. Thus, the increased frictional contact will enable the locking device to support somewhat greater loads.

It will be understood that other cross sectional shapes of the rod 25′ and the hole 48′ may be employed; for example, in a generally polygonal opening, a rod may have a corresponding polygonal shape. The polygonal shapes may vary between triangular to hexagonal and octagonal and others. While the rod 25 is illustrated as rectangular or polygonal in cross sectional configuration it will be understood that other sectional shapes may be employed such as H or I section where the relatively wide flanges of such sections provide substantial linear frictional contact with the opposed edges of the opening 48.

In the present embodiment of the invention, the pivotal movement of the lock member from release horizontal position to tilt lock position is approximately 27°.

In the present embodiment it will be noted that the rod 25 is guided by the lock member 40 and is pivotally connected to the drawing board at a fixed location. The lock device of the present invention may also be employed in the event rod 25 was to be guided at two spaced points for only vertical movement. The rod could be positioned against downward displacement by the employment of one lock member 40. If two lock members 40 were supported in spaced relation in tandem, one above the other, vertical adjustment of a rod passing through openings 48 in such spaced lock members could be achieved without the support or guiding of the rod by other means.

It will also be understood that while the locking device described above has been exemplarily illustrated with respect to the support and adjustment of a drawing board, such lock device may be employed to hold open various devices such as an overhead garage door while replacing broken springs, window adjusters, sliding door locks, and retaining in an open position other types of closures.

It will thus be readily apparent that a drafting board equipped with the locking device of this invention may be readily adjusted to a selected inclined position by using only one hand to lift the board at the edge margin opposite to its hinge connection to the base support table. Adjustment in an upward direction is readily accomplished by lifting and thereby relieving the load of the drawing board from the locking device. In the event inclination of the board is desired at a lower angle, then the board may be simply lifted to its uppermost position where the magnet retention means will hold the locking device in release position until the lock member is released by engagement with the drafting board in a horizontal position which then permits the board to be raised to the new selected inclined position.

In such selected inclined working position of the board, for example in FIG. 3, collar 36 may be moved upwardly to a position just below lock member 40. Lifting the board slightly upward from this position causes the lock member 40 to engage the magnet to hold the lock member in rod release position to permit lowering of the board to horizontal position.

Various modifications and changes may be made in the locking device described above and all such changes and modifications coming within the scope of the appended claims are embraced thereby.

We claim:

1. A tilt lock device for infinitely varying the inclination of a drawing board mounted about a hinge axis along one edge to a base structure between a maximum tilt angle and a minimum tilt angle comprising in combination:

a lock rod pivotally connected at one end to said drawing board and extending downwardly alongside said base structure a lock member pivotally mounted on said base structure and having a plate portion lying in a plane transverse and inclined to the axis of said rod, said plate portion haing a hole therein greater than the cross sectional area of said rod;

said hole having a configuration providing locking 50% contact with the rod surface in relative angular positions of the rod axis and the inclined plane of the plate portion;

and cooperable means on said base structure and on said lock member to hold said pivotally mounted lock member in a position for free relative movement of said rod with respect to said lock member.

2. A device as stated in claim 1 wherein said holding means on said base structure includes magnet means.

3. A device as stated in claim 2 including means on said lock member for disengagement of said magnet means in one position of the drawing board.

4. A device as stated in claim 1 wherein said hole includes a generally octagonal shape with alternate sides of the octagon having a radius equivalent to the radius of an elliptic at ends of its major axis formed by the plane of the plate normally inclined relative to the rod axis in lock position for maximizing contact of the rod with the edges of the hole.

5. A device as stated in claim 1 wherein said hole includes a rectangular configuration and said rod has a corresponding reduced rectangular configuration in cross section.

6. A device as stated in claim 1 wherein said material of said lock member is case hardened to minimize deformation of the rod and lock member at their cooperative surfaces under load.

7. A device as stated in claim 1 including stop means on said rod to engage said lock member to move the lock member to release position by engagement of cooperable means on the lock member and on the base structure.

8. A device as stated in claim 1 wherein the lock member is pivotally connected to the base structure at a location where said rod will have not less than a 2° inclination from the vertical when the drawing board is in horizontal position and the rod passes thru the hole in the lock member.

9. A locking device for an elongated member having one end connected to a load member applying a load to said one end in the direction of the longitudinal axis of the elongated member to limit longitudinal movement thereof and to position said elongated member relative to a lock member pivoted to a base structure to support said load member and to be readily releasable when said load is relieved, said lock member including a plate portion disposed in locking position at an angle to the axis of the elongated member and having a hole therein receiving said elongated member with edges of the hole in frictional contact therewith in locking position;

and means on said base structure engageable by said lock member to retain said lock member in release position with respect to said elongated member.

10. A locking device as stated in claim 9 wherein said elongated member is provided with a circular cross section;

said hole includes curved edges having radii equivalent to the radii of an elliptic determined by passing a plane through the elongated member and at an angle to the axis thereof in a lock position.

11. A device as stated in claim 9 wherein said elongated member is provided with a polygonal cross section;

and said hole in said plate portion is provided with a generally corresponding similar polygonal shape.

12. A lock device as stated in claim 9 wherein said elongated member is provided with a cross sectional shape providing parallel surfaces;

and said hole in said plate portion is provided with an enlarged opening having edges parallel to said elongated member surfaces.

13. A lock device as stated in claim 9 wherein said elongated member has a stop means at the end opposite to said pivotal connection to coact with said lock member to move said lock member about its pivotal connection to release said lock member.

14. A locking device as stated in claim 9 wherein said load member includes a drafting board;

said lock member includes a portion engageable by said drafting board for automatic release of said lock member when said lock member is retained in released position.

15. A locking device as stated in claim 9 wherein at least 50% of the periphery of said elongated member in the plane of said plate portion is engaged by edges of the hole in said plate portion.

16. A locking device as stated in claim 9 wherein substantially greater than a tangential portion of the peripheral surface of said elongated member in the plane of the plate portion is engaged by edges of the hole in the said plate portion.

* * * * *